US006655617B2

(12) United States Patent
Hagedorn et al.

(10) Patent No.: US 6,655,617 B2
(45) Date of Patent: Dec. 2, 2003

(54) DRIVE SYSTEM FOR A TUBE MILL

(75) Inventors: Alexander Hagedorn, Pulheim (DE); Norbert Aufsfeld, Pulheim (DE)

(73) Assignee: KHD Humboldt Wedag AG, Cologne (DE)

( * ) Notice: Subject to any disclaimer, the term of this patent is extended or adjusted under 35 U.S.C. 154(b) by 0 days.

(21) Appl. No.: 10/103,667

(22) Filed: Mar. 21, 2002

(65) Prior Publication Data

US 2002/0158157 A1 Oct. 31, 2002

(30) Foreign Application Priority Data

Mar. 23, 2001 (DE) ..... 101 14 294

(51) Int. Cl.[7] ..... B02C 17/24
(52) U.S. Cl. ..... 241/170; 241/171; 241/179
(58) Field of Search ..... 241/170, 171, 241/174, 176, 178, 179

(56) References Cited

U.S. PATENT DOCUMENTS

| | | | | |
|---|---|---|---|---|
| 2,486,477 A | * | 11/1949 | Kennedy | 241/171 |
| 2,511,742 A | * | 6/1950 | Shafer | 241/171 |
| 2,513,413 A | * | 7/1950 | Huszar | 241/171 |
| 3,078,050 A | * | 2/1963 | Hardinge | 241/171 |

FOREIGN PATENT DOCUMENTS

| | | |
|---|---|---|
| EP | 0 184 326 | 1/1989 |
| EP | 0 175 109 | 1/1990 |

* cited by examiner

*Primary Examiner*—John M. Husar
(74) *Attorney, Agent, or Firm*—Nexsen Pruet Jacobs & Pollard, LLC.; Charles L. Schwab

(57) ABSTRACT

A simply and compactly built drive system for a tube mill is provided whose force transmission is no longer threatened by flexures and other deformations of the grinding tube. A one-piece ring gear having a diameter less than or equal to the diameter of the grinding tube is attached to the small diameter end of a discharge cone of the grinding tube.

5 Claims, 1 Drawing Sheet

DRIVE SYSTEM FOR A TUBE MILL

TECHNICAL FIELD

This invention relates to a drive system for a tube mill having a rotatably mounted grinding tube with a grinding stock feed and having a discharge cone in the shape of a truncated cone floatingly arranged outside the grinding tube mounting at the discharge end of the grinding tube. The discharge cone is closed at its small diameter by an end wall and has a plurality of discharge openings distributed about its circumference for the discharge of the grinding stock and of the mill gas, which discharge openings are enclosed by a stationary stock discharge housing.

BACKGROUND OF THE INVENTION

For the driving of rotary drums such as, for example, tube mills, it is known to mount on the outer circumference of the drum, in rotationally rigid fashion, a ring gear having a T-shaped profile in cross section and with teeth engaged by one or two drive pinions. A rotary drum drive of this type is shown in European patent number 0 175 109 published Jan. 30, 1990 for a Rotary Drum. Flexures of the drum can lead to drum curvatures, which also in combination with various thermal expansions, lead to relative displacements and/or inclinations of the tooth flanks with nonuniform load behavior over the tooth face width, which is detrimental in terms of force transmission, especially when the diameter of the ring gear is, as has been the case heretofore, larger than the diameter of the grinding tube. The large-diameter ring gears are usually assembled from two or more parts, so that the above-cited problems of the ring-gear drive can be further increased by pitch errors of the ring gear.

The so-called central drive shown in European patent number 0 184 326 published Jan. 18, 1989 avoids the conventional ring-gear drive in tube mills. A discharge cone in the shape of a truncated cone is floatingly arranged outside the grinding-tube mounting at the grinding-stock discharge end of the milling-grinding tube, which contains the grinding stock as well as the grinding bodies. The discharge cone is closed by an end wall at its small diameter, which end wall is engaged at the center by the drive shaft of the central drive. The discharge cone has openings distributed about the circumference for the discharge of the grinding stock and of the mill gas. The grinding-stock and mill-gas discharge openings are enclosed by a stationary stock discharge housing into which the ground stock falls downward and is discharged at the bottom while the mill gas, laden with fines, is withdrawn from the stationary stock discharge housing at the top. If this known tube mill were retrofitted with a ring-gear drive on account of necessity, the ring gear would be mounted on the outer circumference of the drum, as was heretofore usual, whereupon the above-described problems resulting from the large diameter of the ring gear would arise again.

OBJECTS OF THE INVENTION

It is an object of the invention to create for a tube mill a simply and compactly built drive system whose force transmission is no longer threatened by flexures and other deformations of the grinding tube.

SUMMARY OF THE INVENTION

In the drive system according to the invention, a drive gear is mounted on the truncated-cone-shaped discharge cone attached at the grinding-stock discharge end of the grinding tube, the drive gear having a diameter not greater than the diameter of the grinding tube. The torque transmitting drive wheel thus has a diameter maximally as large as the grinding-tube diameter, preferably smaller, so that the drive gear differs markedly in diameter from the large ring gears of the known ring-gear drives. In the drive system according to the invention, this comparatively small drive gear is flanged onto the small diameter of the discharge cone in simple fashion. According to an exemplary embodiment of the invention, the small-diameter drive gear is a ring gear which is distinguished first by light weight and comparatively low fabrication cost. The ring gear can be advantageously fabricated in one piece, so that pitch errors, such as occur in the usual large, multi-part ring gears, are avoided. Flexures and other deformations of the grinding tube scarcely manifest themselves on the small-diameter drive gear, so that the drive system according to the invention preserves the force transmission/torque transmission and uniformally distributes the load over the width of the tooth face.

The drive wheel flanged onto the small diameter of the discharge cone of the tube mill is preferably a one-piece ring gear into which at least one drive pinion comes into tooth profile engagement. In order to insure uniform load behavior over the tooth face width, it may be advantageous to make the drive pinion or drive pinions self-aligning in order to compensate for any possible alignment error of the ring gear and/or of the pinions. Furthermore, the ring gear can be kept narrow because the surface of the ring gear can be hardened, for example by induction hardening.

According to a further feature of the invention, the drive gear arranged on the small diameter of the discharge cone need not necessarily be made as a ring gear; the drive wheel can instead bear pole pieces and form the rotor of an electric motor, which rotor is surrounded in contact-free fashion by a stator of a gearless ring-motor drive. The ring motor that comes about in this way, because its rotor and stator are comparatively small in diameter, is correspondingly simple and economical to build. At the same time, the ring-motor drive has a continuously variable speed, and the speed is to be optimally adapted to the properties of the grinding stock as well as the mill-classifier grinding system in which the tube mill is employed.

The ring gear drive, the ring gear and the at least one driving pinion, are enclosed by a stationary ring-gear housing. Only a single ring seal is required between the lateral wall of the ring-gear housing facing toward the discharge cone and toward the small outer diameter of the discharge cone, because the other lateral wall of the ring-gear housing is completely closed. By virtue of the good sealability of the ring-gear housing, oil leaks are minimized in the case of circulating oil lubrication of the ring-gear drive, and even oil-splash lubrication would be possible.

In the drive system according to the invention, the flange arranged on the small diameter of the discharge cone can be made as a multifunction flange, in that the mill drive according to the invention can be retrofitted with a central drive, which then engages on the small diameter of the discharge cone or on its end wall.

BRIEF DESCRIPTION OF THE DRAWING

An exemplary embodiment of the invention is illustrated in the accompanying Drawing.

DETAILED DESCRIPTION OF THE INVENTION

Figure 1:
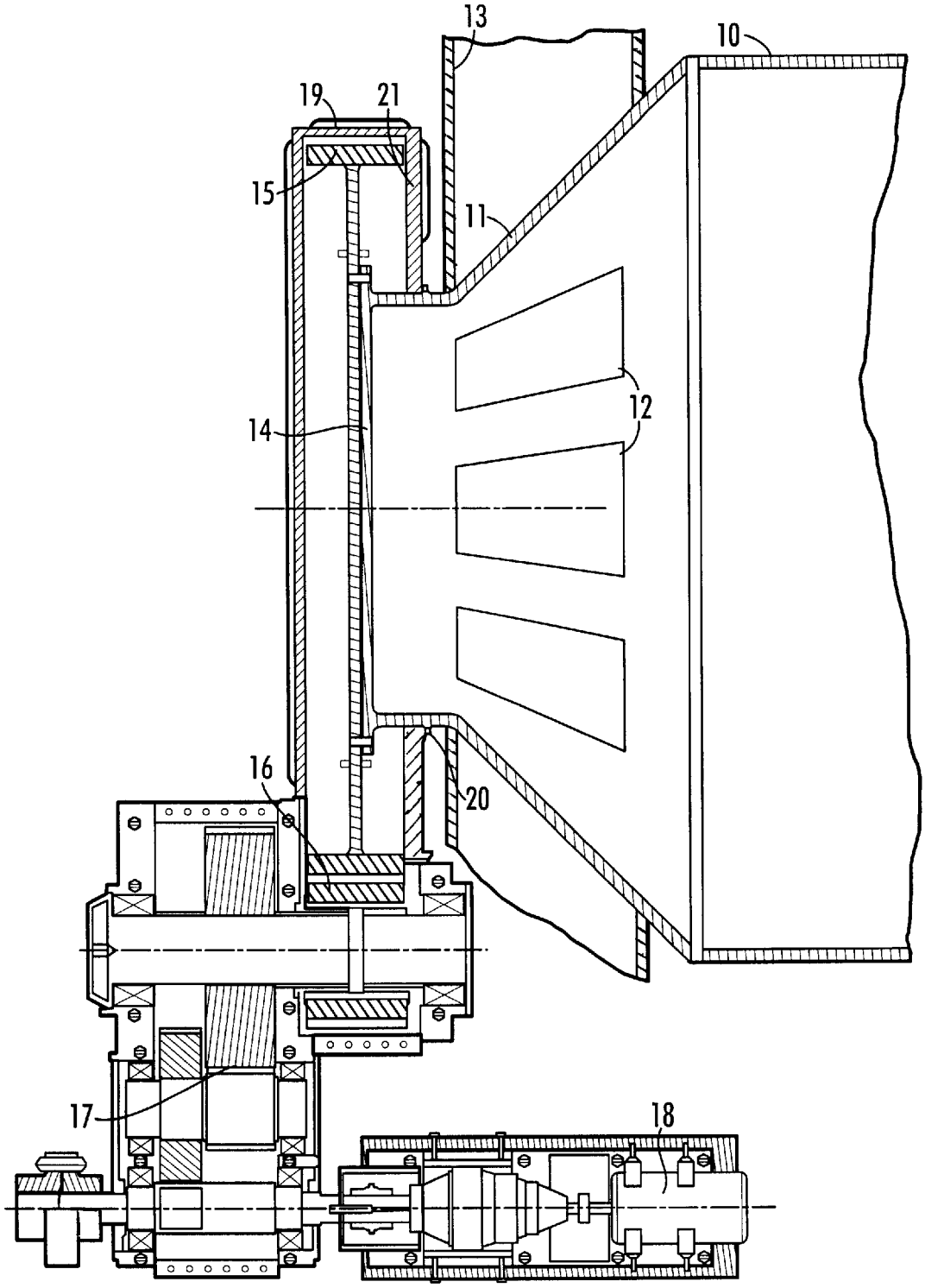

The Drawing is a section view of the left end of a tube mill with a mill tube or grinding tube 10 mounted rotatably on its circumference for rotation about a horizontal axis. The stock for grinding, grinding bodies such as for example steel balls, and mill air, which can also include a hot gas stream in the case of combined milling and drying of moist stocks, enter from the right. Adjacent to the horizontal grinding tube 10 at the grinding-stock discharge end is a floatingly arranged discharge cone 11 in the shape of a truncated cone, via which the tube mill is driven in the manner according to the invention, as will be described in what follows.

A plurality of openings 12 for the discharge of the ground stock as well as the mill air are arranged in distributed fashion about the circumference of discharge cone 11. These discharge openings 12 are enclosed by a stationary stock discharge housing 13, in which the ground stock falls downward, is discharged at the bottom and is conveyed, usually by a bucket conveyor, to a downstream classifier of a closed-circuit grinding system, while the mill gas, laden with fines, is withdrawn from the stationary stock discharge housing 13 at the top and likewise led to the classifier, the oversize material or grit of which is recirculated to the grinding-stock feed end of the tube mill.

Adjacent to the small diameter of truncated-cone-shaped discharge cone 11 is a cylindrical intermediate section, which is closed at its end by an end wall 14. A comparatively small-cross-section, T-flange-shaped, one-piece ring gear 15 is flanged, via its ring-shaped web, onto this end wall or onto the small diameter left end of discharge cone 11, the ring gear 15 having an outside diameter that is smaller than the diameter of grinding tube 10. The comparatively small, one-piece drive ring gear 15, which can also be fabricated economically as a welded construction, is in tooth profile engagement with at least one drive pinion 16, which is advantageously self-aligning and is driven at a speed of, for example, 12 to 18 revolutions per minutes by a main drive, not illustrated, attached at the left side, with a two-speed reducing gearbox 17. Reference numeral 18 identifies an auxiliary drive.

In the simply and compactly constructed drive system according to the inventions, flexures as well as other deformations of the rotary grinding tube 10 have little effect on the position of ring gear 15, so that a uniform load is distributed over the width of the tooth face, especially if ring gear 15 is narrow in construction.

The ring gear 15 and the at least one drive pinion 16 are enclosed by a stationary ring-gear housing 19, which completely encloses the end of the tube mill with its left lateral wall and has only a single ring seal 20 protruding between the lateral wall 21 of the ring-gear housing facing toward discharge cone 11 and facing the small outside diameter of the discharge cone. In this way, possible oil leaks are minimized in the case of circulating oil lubrication of the ring-gear drive, and it is even possible to employ oil-splash lubrication.

The illustrated construction is particularly well suited for use in a rotary tube mill having the grinding tube 10 rotatably supported on its circumference for rotation about a substantially horizontal axis. The discharge cone 11 is in the shape of a truncated cone, having a large diameter end rigidly secured to the discharge end of the grinding tube 10 and a small diameter end closed by an end wall 14 perpendicular to the axis of rotation of the grinding tube 10. The discharge cone 11 is supported only by the connection of its large diameter end to the grinding tube 10. The end wall 14 of the discharge cone 11 provides a convenient torque transmitting member to which the large diameter ring gear 15 is attached. The ground stock and the mill air are discharged radially through a plurality of circumferentially spaced radial openings 12 in the truncated cone, rather than axially through the small end of the discharge cone 11. A radially outward facing cylindrical surface on the small end of the truncated cone provides a convenient sealing surface for a ring seal 20 between the discharge cone 11 and the laterally inner wall 21 of a stationary ring gear housing 19. By placing the discharge openings 12 in the discharge cone 11 and attaching the drive gear 15 on the small end of the cone, only one seal is required for sealing the ring gear housing 19 relative to the rotating discharge cone 11. The illustrated construction permits the ring gear 15 to have a diameter that is smaller than the diameter of the grinding tube 10. Placing the ring gear 15 on the end of the discharge cone isolates the ring gear 15 from the effect of flexures and distortions of the grinding tube 10, which occur during operation of the tube mill, and the tooth loading is more uniform over the width of the gear teeth, thereby providing a longer service life for the ring gear (15). Besides tube mills, the drive system may have applications in other rotary drums, for example drum dryers or the like.

What is claimed is:

1. A rotary tube mill comprising:

a grinding tube (10) mounted for rotation about a horizontal axis and having a stock feed end and a discharge end, a discharge cone (11) in the shape of a truncated cone having large diameter end rigidly secured in coaxial relation to said discharge end of said grinding tube (10) to provide the sole support for said discharge cone, a small diameter end closed by an end wall (14) and a plurality of circumferentially spaced radial discharge openings (12) formed in said discharge cone (11) permitting radial discharge of grinding stock and mill gas, a stationary stock discharge housing (13) circumferentially encompassing the portion of said discharge cone (11) in which said discharge openings (12) are formed, and a drive gear (15) rigidly secured to said small diameter end of said discharge cone (11), said drive gear (15) having a diameter smaller than the diameter of said grinding tube (10).

2. The tube mill as set forth in claim 1 having a stationary ring gear housing (19) including a radial wall (21) extending radially relative to said horizontal axis and positioned axially between said drive gear (15) and said stock discharge housing (13), said radial wall (21) having an annular opening in sealing engagement with said small diameter end of said discharge cone (11).

3. The tube mill as set forth in claim 2 wherein said small diameter end of said discharge cone (11) includes a cylindrical surface and further comprising a rotary seal between said annular opening in said radial wall (21) and said cylindrical surface.

4. The tube mill as set forth in claim 1 wherein said drive gear (15) is nonrotably secured to said end wall (14).

5. The tube mill as set forth in claim 1 wherein said grinding tube (10) is mounted rotatably on its circumference.

* * * * *